United States Patent [19]

Klink et al.

[11] Patent Number: 4,980,996

[45] Date of Patent: Jan. 1, 1991

[54] METHOD AND TOOL FOR MACHINING THE SURFACES OF WORKPIECES

[75] Inventors: Ulrich Klink, Neuffen; Gerhard Sandhof, Leinfelden-Echterdingen, both of Fed. Rep. of Germany

[73] Assignee: Maschinenfabrik Gehring Gesellschaft mit beschränkter Haftung & Co. Kommanditgesellschaft, Ostfildern, Fed. Rep. of Germany

[21] Appl. No.: 206,215

[22] Filed: Jun. 13, 1988

[30] Foreign Application Priority Data

Jun. 13, 1987 [DE] Fed. Rep. of Germany ..... 3719796

[51] Int. Cl.[5] ..... B24B 5/08

[52] U.S. Cl. ..... 51/290; 51/5 A; 51/326; 29/888.06

[58] Field of Search ..... 51/290, 326, 267, 181 R, 51/34 H, 34 J, 346, 340, 3, 4, 5 A, 330–332, 334, 336; 29/888.06, 888.061, 888.01

[56] References Cited

U.S. PATENT DOCUMENTS

| | | | |
|---|---|---|---|
| 36,923 | 11/1862 | Storms | 51/181 R |
| 2,166,281 | 7/1939 | Beck | 51/331 |
| 3,384,915 | 5/1968 | Rands | 15/179 |
| 4,434,588 | 3/1984 | Wada | 51/181 R |

FOREIGN PATENT DOCUMENTS

| | | | |
|---|---|---|---|
| 0247572 | 12/1987 | European Pat. Off. . | |
| 0016993 | 2/1978 | Japan | 51/346 |

OTHER PUBLICATIONS

VDI-Magazine, Gerhard Flores, Jun. 1986, pp. 439–442.

*Primary Examiner*—Robert A. Rose
*Attorney, Agent, or Firm*—Robert W. Becker

[57] ABSTRACT

A method and tool for machining the surfaces of workpieces. The surface is finished by honing high pressure fluid jetting, and brushing. The tool used in this connection is provided with at least one tool element, such as a honing bar and/or a brush bar, and at least one spray or jetting mechanism.

19 Claims, 6 Drawing Sheets

METHOD AND TOOL FOR MACHINING THE SURFACES OF WORKPIECES

BACKGROUND OF THE INVENTION

The present invention relates to a method and a tool for machining the surfaces of workpieces, especially the bore surfaces of internal combustion engines.

The goal of any fine machining operation is, among other things, to produce fully functional surfaces. A typical application for a honing operation is the machining of piston or cylinder bore surfaces in spark-ignition and Diesel engines. Honing involves a cutting or machining with a multi-cutting tool of bound grains or crystals, accompanied by constant surface contact between tool and workpiece. The cutting movement is formed by a rotational movement and a back and forth as reciprocating movement. The honed surface exhibits fine, criss-crossing channels or grooves. In this connection, as with all cutting processes, the material structure is deformed in the region of the edge zones. Via an appropriate enlargement or magnification, one can recognize a surface structure where the cutting edges of the honing grooves are spread and overlap. Partially due to overlapping the cross-sectional areas of the honing grooves directly at the surface are less than below. This surface deformation of the honed bore surface is known in technical circles as "metal nap", and has a disadvantageous impact upon the breaking-in and running conditions of the friction partners piston rings/cylinder bore surface, increases the tendency to form burned channels and to score, and leads to an increased initial oil consumption.

Users of the honing process, especially manufacturers of internal combustion engines, have therefore tried for a long time to produce a surface that is as free of metal nap as possible; however, up to now this has not been possible to any satisfactory extent.

For example, a method of the aforementioned general type has become known where the bore surfaces are electrochemically honed and are subsequently subjected to high pressure spray with a liquid stream or fluid jetting with oil, water and the like.

In this method, not only residues from the electrochemical machining are to be removed but also loosened structure is to be removed; on the other hand, the graphite pockets or clusters that are embedded or incorporated in the structure are not to be destroyed or loosened.

A drawback of this heretofore known method is that the electrochemical machining requires a very high technical outlay and capital expenditure, and places high requirements on the corrosion resistance of the honing unit, thereby considerably increasing the expense of the overall machining process.

It is furthermore known to mechanically hone the bore surfaces and to subsequently undertake a further machining or processing in a spray or fluid jetting unit with a liquid stream under high pressure. Here too considerable capital expenditure is necessary due to the separate units. In addition, the results achieved are not satisfactory in all situations. This is based essentially on the fact that the spray or fluid pressure that is required in order to satisfactorily eliminate the metal nap can directly lead to a destruction of the graphite pockets in the structure, as a result of which it is not possible to achieve an optimum production run of bore surfaces.

It is therefore an object of the present invention to provide a method and tool of the aforementioned general type that avoid the indicated drawbacks and which assure that a surface that is free of metal nap can be obtained without, however, destroying or loosening the graphite pockets that are incorporated in the structure.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The method of the present invention includes the steps of honing, high pressure or fluid jetting spraying, and brushing a surface that is to be machined. This is accomplished with a tool that comprises at least one tool element, and at least one spray or fluid jetting mechanism, which is provided with outlet means.

By carrying out at the conclusion of a honing process a combined high pressure spraying or fluid jetting and brushing treatment, a surface is achieved that is free of metal nap, without in the process damaging or loosening the graphite pockets that are incorporated in the structure.

By means of the inventive tool, the method of the present invention can be carried out in a straightforward manner with only a few steps. Furthermore, the capital expenditure for equipment is considerably reduced as a result of the combined arrangement of the spray or fluid jetting mechanism and the tool element, with which a further step can be carried out.

Further specific features of the present invention will be described in detail subsequently.

DESCRIPTION OF THE PREFERRED EMBODIMENTS

Figure 1:
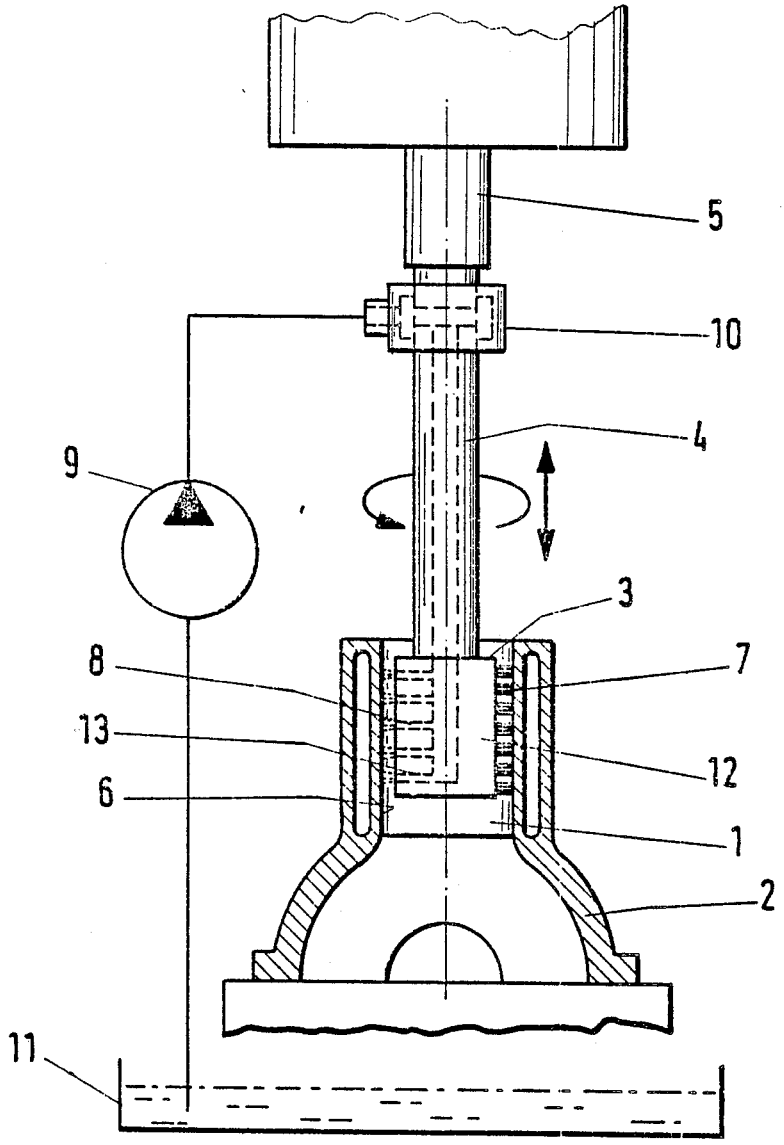
FIG. 1 is a view that shows an apparatus for explaining the method of the present invention.

Referring now to the drawings in detail, a cylinder bore 1 of an engine block 2 is being machined in the apparatus illustrated in FIG. 1. The cylinder bore 1, which was previously bored in a known manner, and was subsequently honed in a honing machine, is now further machined by a combination spraying or fluid jetting and brushing tool 3. The tool 3 is rotatably driven, and carries out a back and forth stroke movement in the direction of the axis of the bore. Preferably, the same kinematic conditions exist as during the previous honing.

Via a connecting rod 4, the tool 3 is connected to a machine arbor 5, which is rotatably driven by a non-illustrated, known rotary drive. In addition, the machine arbor 5 is alternately moved upwardly and downwardly by a non-illustrated lifting mechanism, such as a piston/cylinder arrangement, in such a way that the tool 3 is repeatedly guided in a helical fashion over the entire area of the bore or contact surface 6 of the cylinder bore 1 The tool body 12 carries brushes 7 that rest against the bore surface 6 of the cylinder bore 1. In addition, a spray or fluid jetting mechanism 13 is provided on the tool body 12. The spray or fluid jetting mechanism 13 has outlets that are embodied as nozzle openings or jets 8, and via which a high pressure liquid or fluid spray is directed against the surface 6 of the cylinder bore 1. For this purpose, the nozzle openings or jets 8 communicate with a source 9 of high pressure medium; the source 9 is supplied with liquid, preferably honing oil, from an appropriate reservoir 11. The communication between the source 9 of high pressure medium and the nozzle openings or jets 8 is effected via a distribution arrangement 10 that is disposed on the machine arbor 5, and that supplies the liquid to the tool 3 via the connecting rod 4, which is, for example, hollow.

With the apparatus of FIG. 1, the surface 6 of the cylinder bore 1 is sprayed or fine finished by high pressure fluid jetting and brushed in a single operating stage, whereby it is possible to carry out the spraying or fluid jetting and brushing processes either simultaneously and/or one after the other. This will be explained in detail subsequently with the aid of several differently embodied tools.

Figure 2:
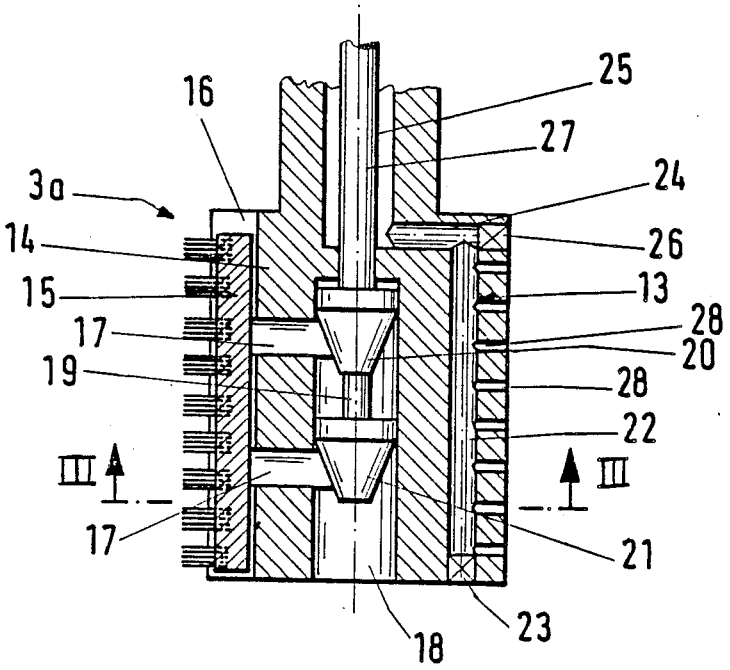
FIG. 2 is an axial cross-sectional view through a first exemplary embodiment of the inventive tool.
Figure 3:
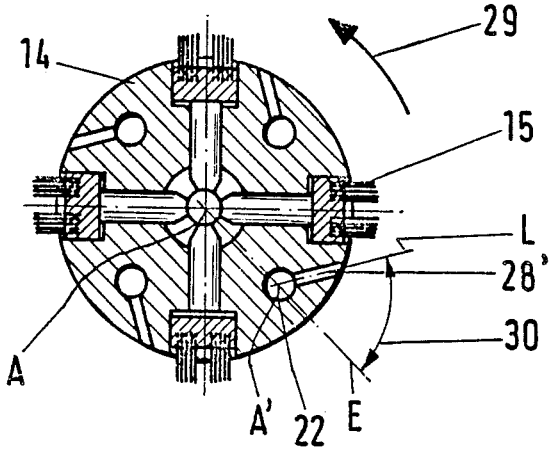
FIG. 3 is a cross-sectional view taken along the line III—III in FIG. 2.

FIGS. 2 and 3 schematically show a tool 3*a* for the combined fluid jetting or spray and brush treatment of a previously honed bore surface. The tool 3*a* essentially comprises a hollow cylindrical tool body 14, the outer periphery of which carries a plurality of, for example four, uniformly distributed, displaceable tool elements that are embodied as bars 15 with brushes. The brush bars 15 are guided in grooves or slots 16 of a tool body 14, and cooperate via pusher-type elements 17 with a displacement mechanism 19 that is disposed in the inner chamber 18 of the tool body 14. The displacement mechanism 19 is provided with two conical members 20, 21 that have the same inclination as do the pusher-type elements 17, and that cooperate with the latter in such a way that during an axial movement of the displacement mechanism 19 via a connecting rod 27, the brush bars 15 are shifted radially outwardly.

Provided between each two brush bars 15 is a liquid channel of the spray or jetting mechanism 13. Each liquid channel extends axially in the tool body 14, and is embodied as a longitudinal bore 22, the bottom end of which is closed off by a plug or stopper 23. Each of the longitudinal bores 22 opens into a cross channel 24, which in turn opens into an annular channel 25 that is provided in the interior of the tool body 14. The outer ends of the cross channels 24 are each closed off by a plug or stopper 26. The annular channel 25, which surrounds the connecting rod 27 of the displacement mechanism 19, continues in the connecting rod 4 (FIG. 1), and establishes communication between the longitudinal bores 22 and the source 9 of high pressure medium via the distribution arrangement 10.

A plurality of nozzle openings or holes or jets 28 extend outwardly from each longitudinal bore 22 (FIG. 2). These nozzle holes or jets 28 preferably extend radially and are disposed equidistantly one above the other in the axial direction.

Pursuant to one preferred embodiment of the present invention, the nozzle holes or jets 28' (FIG. 3) are inclined at an angle toward the front in the direction toward the brush bars 15 that are leading them in the direction of rotation of the tool (arrow 29). The angle 30 between the longitudinal axis L of the pertaining jet or nozzle hole 28' and an axial plane E that contains the longitudinal central axes A and A' of the tool body 14 and of the respective longitudinal bore 22 respectively is preferably approximately 30° to 60°.

The direction of rotation (the arrow 29) for the combination jetting or spraying and brushing tool 3*a* is preferably selected in such a way that this direction of rotation is opposite to the preceding honing operation. In this way, the liquid stream that is discharged in a fluid jetting from the nozzle holes or jets 28, 28' a jetting tool or nozzle at high pressure is directed at an acute angle against the overlapping cutting edges of the honing grooves that result during the honing operation. As a result, the overlapping edges are raised and are removed by the following brush bar. A particularly satisfactory surface structure of the bore surface is achieved if the high pressure fluid jetting is undertaken at a pressure of about 100 to 700 bar.

Figure 4:
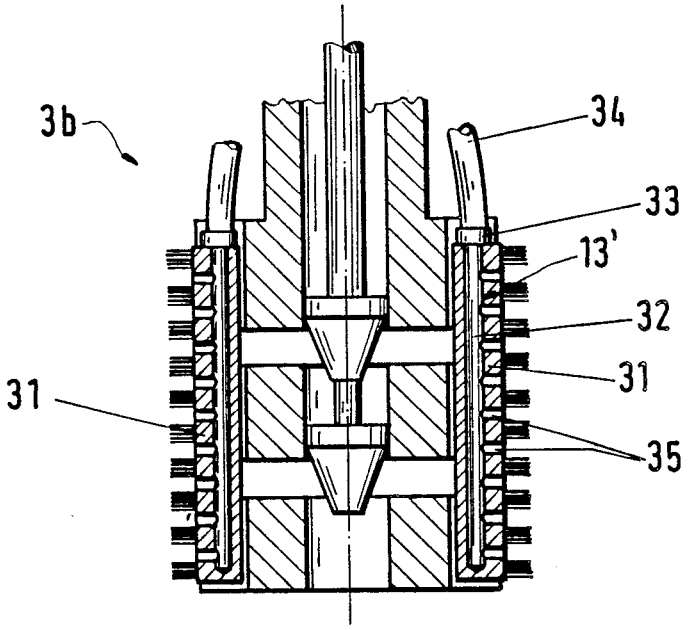
FIG. 4 is an axial cross-sectional view through a further exemplary embodiment of the inventive tool.

FIG. 4 schematically illustrates a further tool 3*b* for the combined jetting or spray and brush treatment of a previously honed bore surface. The tool 3*b* carries at least three, and preferably four or six, radially displaceable brush bars 31. As also shown in FIG. 4, the spray or jetting mechanism 13' is provided within the brush bars 31 with the longitudinal bores 32 for the supply of the high pressure liquid, and with the nozzle holes or jets 35. The longitudinal bores 32 are each formed by an axially extending blind hole. Disposed at the upper open end of each blind hole is a nipple or fitting 33 that is connected to a delivery line 34. The latter is connected to an appropriate distribution arrangement 10 (FIG. 1), as a consequence of which the blind hole bores 32 are connected to the source 9 of high pressure medium.

In a manner similar to the previously described embodiment, in the embodiment of FIG. 4 a plurality of nozzle holes or jets 35, which are preferably disposed equidistantly one above the other in the axial direction, extend radially outwardly from each longitudinal bore 32 and respectively open between bristle sets of the brush bars 31.

Figure 5:
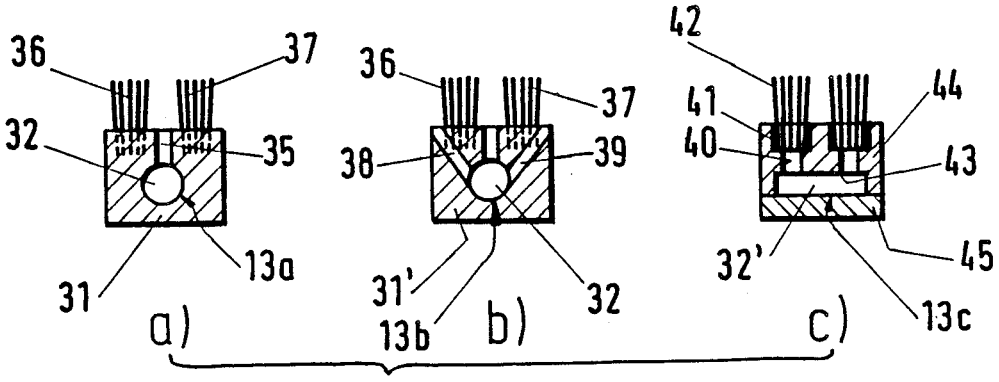
FIGS. 5*a*–5*c* are simplified cross-sectional views through a brush bar of the tool of FIG. 4.

FIGS. 5*a* to 5*c* show various embodiments of brush bars 31 having integrated spray or jetting mechanisms 13*a* to 13*c*. In the spray or jetting mechanism 13*a* of FIG. 5*a*, starting from the central longitudinal bore 32 in the brush bar 31 there is provided a radially extending nozzle hole or jet 35 that opens between two rows of bristles 36, 37. A plurality of nozzle holes or jets 35 are preferably provided in the longitudinal direction of the brush bars 31 (FIG. 4), with these nozzle holes or jets 35 preferably being disposed equidistantly one after the other.

A particularly effective and intensive fluid jetting or spray effect is achieved if the spray or jetting mechanism 13*b* of FIG. 5*b* is provided with additional nozzle holes or jets 38 and 39 in the brush bar 31. These additional nozzle holes or jets extend outwardly at an angle from the longitudinal bore 32 to opposite sides of the bristle rows 36 and 37.

As shown in FIG. 5*c*, the supply of fluid medium can also be effected directly through connecting bores 40, 41 of the individual tufts of bristles 42. The bores 42 extend from a rectangular recess 43 on the underside of the bar body 44 to the tufts of bristles 42. On that side remote from the bristles, the recess 43 is closed off by a cover strip 45 and forms a longitudinal channel 32' of the spray or jetting mechanism 13*c* for the supply of liquid medium.

Also with the embodiment of FIG. 5*c*, it can be expedient to provide additional nozzle holes or jets that extend at an angle similar to the additional nozzle holes or jets shown in FIG. 5*b*.

Figure 6:
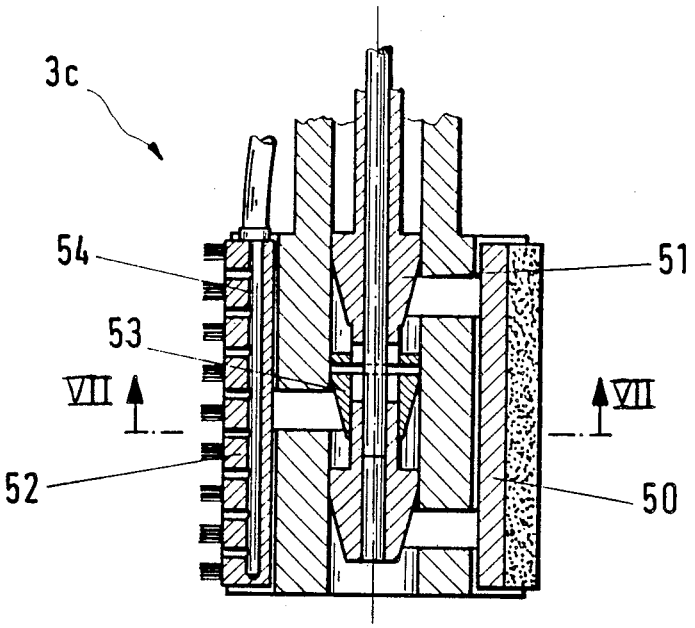
FIG. 6 is an axial cross-sectional view of another exemplary embodiment of the inventive tool.
Figure 7:
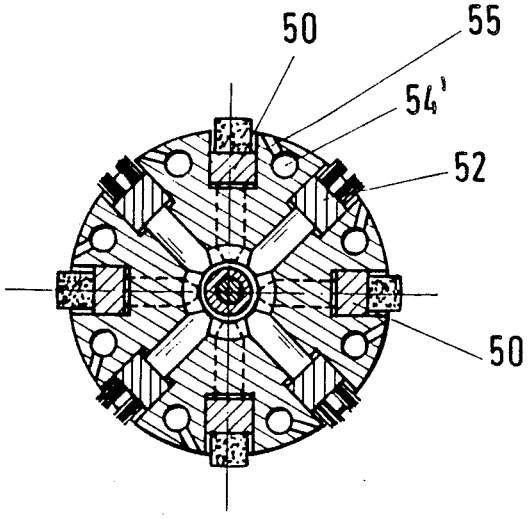
FIG. 7 is a cross-sectional view of a modified embodiment taken along the line VII—VII in FIG. 6

FIGS. 6 and 7 show a particularly advantageous embodiment of a tool 3*c* that is provided for the combined honing, high pressure fluid jetting or spraying, and brushing of the surface of a cylinder bore. In order to carry out the honing operation, the tool is provided with four honing bars 50 that can be displaced in the radial direction in a known manner by a first displacement mechanism 51. Provided between each two honing bars 50 is a respective brush bar 52 that, via a similarly known displacement mechanism 53, can be displaced independently of the honing bars 50. Four honing bars as well as four brush bars are advantageously provided.

The spray or fluid jetting mechanism 54, as shown in FIG. 6, can be integrated in the brush bars 52. This construction is similar to that of the brush bars 31 of the embodiment of FIG. 4.

However, the spray or fluid jetting mechanism 54' (FIG. 7) can also be provided in the tool body in conformity with the embodiment illustrated in FIG. 2, with respective nozzle holes or jets 55 being provided between each honing bar 50 and brush bar 52. With the tool 3*c*, it is possible in a single operating stage to successively or simultaneously carry out process steps. Thus, for example, it is possible to advantageously jet fluid at the same time that the honing operation is being carried out, whereby the cutting conditions of the honing stones can be improved by optimum lubrication and heat and chip withdrawal in such a way that low honing pressures are possible, which counteracts the formation of the overlappings that are known as "metal nap". Lower honing pressures also imply a reduced deformation of the workpiece; in other words, the precision of the machining is also improved. Following the honing operation, without interruption, is a further spraying or fluid jetting and additional brushing operation. At the start of the brushing operation, the direction of rotation of the tool is preferably changed, as a result of which the overlappings or metal naps, and the deformations, that result during the honing process can be better raised and removed. Particularly good results are obtained if the brushing process is undertaken with an increased fluid pressure.

Figure 8:
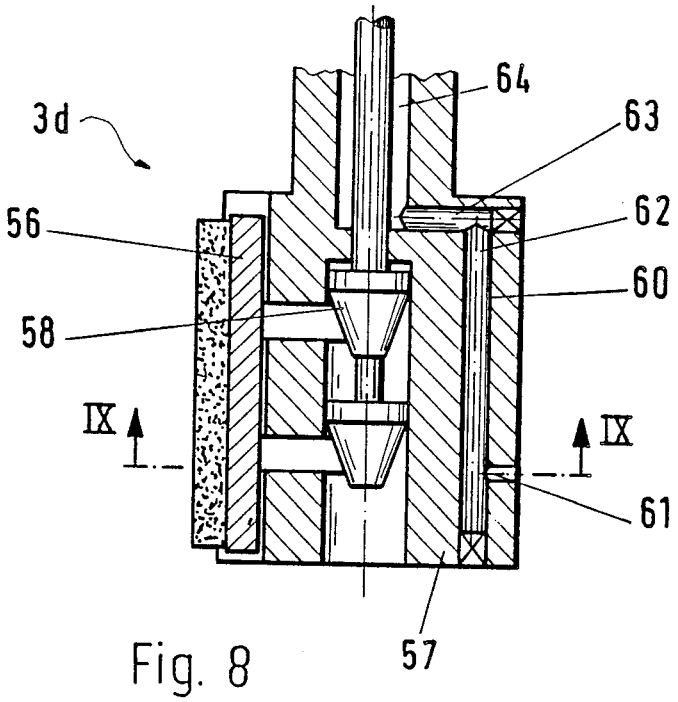
FIG. 8 is an axial cross-sectional view of a further exemplary embodiment of an inventive tool.
Figure 9:
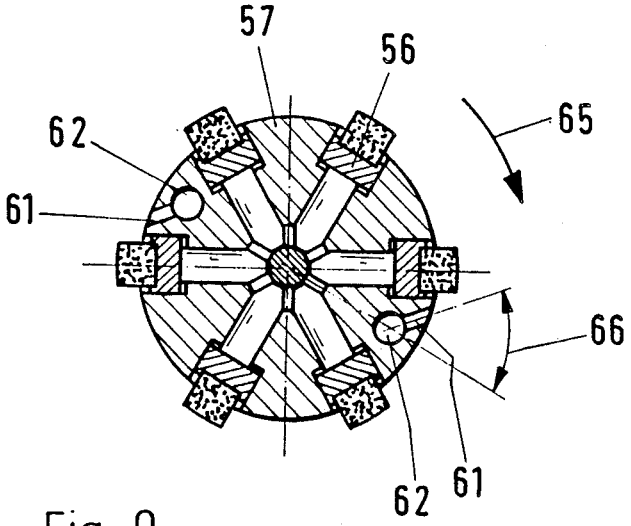
FIG. 9 is a cross-sectional view taken along the line IX—IX in FIG. 8.

FIGS. 8 and 9 show a further specific embodiment of a tool 3*d* that is provided for the combined honing and high pressure fluid jetting of the surface of a workpiece, especially the surface of the cylinder bore. The tool 3*d* is provided with six honing bars 56 that, in a known manner, are distributed, preferably uniformly, on the periphery of the tool body 57, and that can be displaced radially via a displacement mechanism 58.

Provided in the tool body 57 between at least two adjacent honing bars 56 is a spray or fluid jetting mechanism 60 that essentially comprises two longitudinal bores 60 and a radially outwardly directed pair of nozzle holes or jets 61. Each of the longitudinal bores 62 communicates with a cross channel 63 and an axially extending annular channel 64. Via the channel 62 to 64, the nozzle holes or jets 61 are supplied with high pressure liquid from the source 9 of high pressure medium (FIG. 1) via the distribution arrangement 10. The nozzle holes or jets 61 (FIG. 9) are preferably inclined outwardly at an angle and toward a honing bar 56 that is trailing in the direction of rotation (arrow 65). Particularly good results have been achieved with a angle 66 of approximately 30° to 60°. The nozzle holes or jets 61 and the axially extending longitudinal bores 62 are preferably disposed diametrically across from one another. The fluid jetting or spray processing can be carried out at the conclusion of the honing operation, for example during at least one stroke that is carried out at a reduced stroke rate. Preferably, however, the fluid jetting or spray processing is carried out during withdrawal of the tool from the workpiece bore after conclusion of the honing operation, whereupon the surface is brushed.

The fluid jetting or spraying operation is advantageously carried out during the honing operation, at least periodically. In such a case, it is advantageous to embody the spray or jetting mechanism in the manner described in conjunction with the tool of FIGS. 2 or 3. In this case, a plurality of nozzle holes or jets 61 are provided in the longitudinal direction in the tool body 57, preferably equidistantly one after the other.

Figure 10:
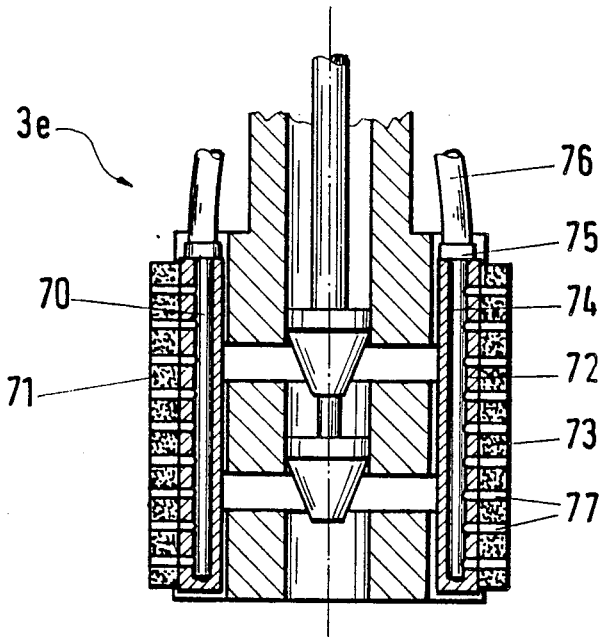
FIG. 10 is an axial cross-sectional view of yet another exemplary embodiment of an inventive tool.

In the embodiment of the tool 3*e* illustrated in FIG. 10, the spray or fluid jetting mechanism 70 is integrated in the honing bar 71. The latter comprises a base bar 72 to which is secured a honing stone 73, for example by adhesion or soldering. Provided in the base strip 72 is the longitudinal bore 74, which is embodied as a blind hole and which is connected to a delivery line 76 via a fitting 75. The delivery line 76 is connected to an appropriate distribution arrangement 10 (FIG. 1), as a result of which the longitudinal bore 74 is connected to the source 9 of high pressure medium.

Connected to each longitudinal bore 74 are nozzle holes or jets 77 that are disposed equidistantly one above the other. The nozzle holes or jets 77 extend approximately radially outwardly, and convey the liquid medium through the honing stones, and/or directly adjacent the honing stones, onto the surface of the workpiece.

Figure 11:
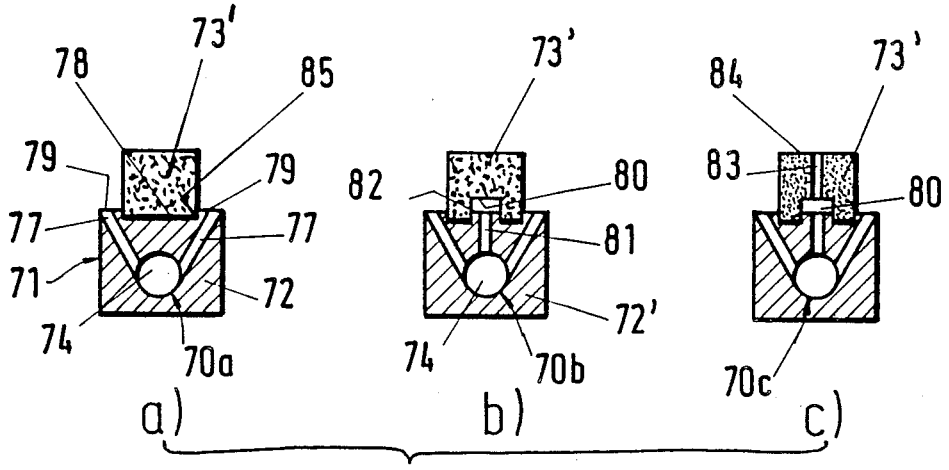
FIGS. 11*a*–11*c* are simplified cross-sectional views through a honing bar of the tool of FIG. 10.

The cross-sectional views of FIGS. 11*a* to 11*c* schematically show various embodiments of the honing bar 71 with the integrated or jetting spray mechanism 70*a* to 70*c*.

In the embodiment of FIG. 11*a*, the honing stone 73' is, as known, received in a recess 85 of an appropriately wide base strip 72, and is held in this recess via an adhesive or soldering layer 78. As a result, narrow raised portions 79 of the base strip 72 are formed on both sides of the honing stone 73'. From the central longitudinal bore 74 of the spray or fluid jetting mechanism 70*a* in the base strip 72, nozzle holes or jets 72 extend at an angle outwardly and to both sides of the raised portions 79. As shown in FIG. 11*a*, the liquid medium exits directly on both sides of the honing stone 73', as a result of which, in addition to the intended jetting or spraying effect, a good cooling and lubricating effect is achieved for the honing stone.

This effect is increased even further with the honing bar of FIG. 11*b* by having additional liquid pressed through the porous structure of the honing stone 73'. For this purpose, the back side of the honing stone 73, which faces the base strip 72', is provided with a groove-like recess 80 that communicates with the longitudinal bore 74 via a plurality of radially extending holes or jets 81 or slots of the spray or jetting mechanism 80 that are disposed one above the other and are spaced apart in the axial direction. In the region of the opening of the hole or jet 81, the base bar 72' is provided with a raised portion 82 that extends into the groove-like recess 80 of the honing stone 73'. The raised portion 82 prevents possible clogging of the hole or jet 81 when the honing stone 73' is secured to the base bar.

Where the honing stone 73' is fine-grained and/or is not very porous, it is possible, as shown in FIG. 11*c*, to provide in the honing stone 73' additional nozzle holes or jets 83 that extend outwardly from the recess 80 and open in the working surface 84 of the honing stone.

In addition to the specific embodiments that have already been illustrated it is to be understood that other embodiments could also be possible. For example, it could be advantageous to combine differently embodied spray or jetting mechanisms within a tool. In other words, in addition to spray nozzles or jets in the tool body, additional spray nozzles or jets can be provided within the honing and/or brush bars.

The present invention is, of course, in no way restricted to the specific disclosure of the specification and drawings, but also encompasses any modifications within the scope of the appended claims.

What we claim is:

1. A method of machining the surfaces of workpieces, especially the bore surfaces of internal combustion engines, said method including the steps of honing with a honing tool via rotation in a predetermined direction of rotation, then high pressure spraying of fluid to eliminate metal nap as well as for a good cooling and lubricating effect as to the honing tool, and brushing a surface that is honed, carrying out said honing by rotating said honing tool in a first direction or rotation, and carrying out said high pressure spraying and said brushing in a second direction or rotation that is opposite to said first direction of rotation.

2. A method of machining the surfaces or workpieces, especially the bore surfaces of internal combustion engines, said method including the steps of honing with a honing tool, then high pressure spraying of fluid to eliminate metal nap as well as for a good cooling and lubricating effect as to the honing tool, and subsequently brushing a surface that is to be machined; and carrying out said spraying at the conclusion of said honing operation.

3. A method according to claim 2, which includes the step of first effecting said honing, and then together effecting said high pressure spraying and said brushing.

4. A method according to claim 2, which includes the step of at least periodically effecting said high pressure spraying and said brushing simultaneously.

5. A method according to claim 2, which includes the step of first effecting said honing, and then carrying out, under the same kinematic conditions as existed with said honing, said high pressure spraying and said brushing.

6. A method according to claim 2 which includes the step of together carrying out said honing, high pressure spraying, and brushing.

7. A method according to claim 6, which includes the step of at least periodically simultaneously carrying out said spraying during said honing operation.

8. A method of machining for fine finishing honing a surface of a bore in a workpiece, especially a cylinder bore in a cylinder block of an internal combustion engine, said method including the steps of honing the bore with a honing tool driven in rotational and reciprocating movement, said honing tool having finishing honing stones provided therewith and including the steps of performing in combination with said fine finishing honing additionally a processing of the bore surface by high-pressure jetting of fluid by means of a jetting tool provided with nozzles to eliminate metal nap and by brushing of the bore surface with brushes under the same kinematic conditions as said honing stones moving in the rotational and reciprocating movement along the bore surface.

9. A method according to claim 8, which includes the step of first effecting said honing, and together effecting said high pressure fluid jetting and said brushing.

10. A method according to claim 8, which includes the step of at least periodically effecting said high pressure fluid jetting and said brushing simultaneously.

11. A method according to claim 8, which includes the step of first effecting said honing, and then carrying out, under the same kinematic conditions as existed with said honing, said high pressure fluid jetting and said brushing.

12. A method according to claim 8, which includes the step of carrying out said honing by rotating said honing tool in a first direction of rotation, and carrying out said high pressure fluid jetting and said brushing by rotating said jetting tool and said honing stones in a second direction of rotation that is opposite to said first direction of rotation.

13. A method according to claim 8, which includes the step of carrying out said honing, high pressure fluid jetting, and brushing during reciprocating said honing tool.

14. A method according to claim 13, which includes the step of at least periodically simultaneously carrying out said fluid jetting during said honing operation.

15. A method according to claim 8, which includes the step of carrying out said fluid jetting after terminating said honing operation.

16. A method according to claim 15, which includes the steps of withdrawing said honing stones from said bore surface after terminating said honing operation and carrying out said fluid jetting during moving said honing tool out of the bore at a reduced stroke speed.

17. A method according to claim 8, which includes the step of carrying out said high pressure fluid jetting at a pressure of about 100 to 700 bar.

18. A method according to claim 2, which includes the steps of providing a tool to effect said machining, withdrawing said tool from a workpiece surface at the conclusion of said honing operation and at a reduced stroke speed, and carrying out said spraying during said tool withdrawal.

19. A method of machining the surfaces of workpieces, especially the bore surfaces of internal combustion engines, said method including the steps of honing with a honing tool, then high pressure spraying of fluid to eliminate metal nap as well as for a good cooling and lubricating effect as to the honing tool, and subsequently brushing a surface that is to be machined, and carrying out said high pressure spraying at about 100 to 700 bar.

* * * * *